US006035589A

United States Patent [19]

Schmucki et al.

[11] Patent Number: 6,035,589

[45] Date of Patent: Mar. 14, 2000

[54] FRAMEWORK, ESPECIALLY FOR FASTENING PLUMBING UNITS

[75] Inventors: Peter Schmucki, Eschenbach; Silvio Marti, Rapperswil; Alfred Mahler, Jona, all of Switzerland

[73] Assignee: Geberit Technik AG, Jona, Switzerland

[21] Appl. No.: 08/787,388

[22] Filed: Jan. 22, 1997

[30] Foreign Application Priority Data

Jan. 23, 1996 [CH] Switzerland ..... 170/96

[51] Int. Cl.[7] ..... E04B 2/28; F16L 3/00

[52] U.S. Cl. ..... 52/126.1; 52/34; 52/653.1; 248/49; 248/295.11; 248/188.5; 403/104; 403/231

[58] Field of Search ..... 52/126.1, 126.2, 52/34, 651.02, 653.1, 656.2, 220.1, 220.8, 651.1; 248/49, 74.1, 158, 297.21, 295.11, 188.5, 188.8; 403/109.1, 104, 231, 230, 377, 329

[56] References Cited

U.S. PATENT DOCUMENTS

| | | | |
|---|---|---|---|
| 1,611,057 | 12/1926 | Neil | 403/104 X |
| 3,915,102 | 10/1975 | Barron | 248/188.5 X |
| 4,080,080 | 3/1978 | Cisler | 248/188.5 X |
| 4,252,466 | 2/1981 | Berti et al. | 248/49 X |
| 4,378,173 | 3/1983 | Hopwell | 248/188.5 X |
| 4,627,516 | 12/1986 | Studer | 248/188.3 X |
| 5,094,320 | 3/1992 | Deitz et al. | 248/188.8 X |
| 5,163,642 | 11/1992 | Torrens et al. | 248/49 |

FOREIGN PATENT DOCUMENTS

| | | | |
|---|---|---|---|
| 854 052 | 5/1940 | France . | |
| 94 06 980 | 8/1994 | Germany . | |
| 295 14 312 U | 12/1995 | Germany . | |
| 1017226 | 1/1966 | United Kingdom | 52/34 |
| 1526049 | 9/1978 | United Kingdom | 248/157 |

*Primary Examiner*—Carl D. Friedman
*Assistant Examiner*—Winnie Yip
*Attorney, Agent, or Firm*—Collen Law Associates, P.C.

[57] ABSTRACT

The framework has at least one vertical support column (3), into which a telescopically height-adjustable foot (4) connected to the support column (3) is inserted. An approximate presetting and subsequently a fine height adjustment are possible by means of a height-adjustable adjusting member (15), which is self-supporting at the foot (4).

17 Claims, 3 Drawing Sheets

FRAMEWORK, ESPECIALLY FOR FASTENING PLUMBING UNITS

FIELD OF THE INVENTION

The present invention pertains to a framework, especially for fastening plumbing units, with at least one vertical support column, into which a telescopically height-adjustable foot connected to the support column is inserted.

BACKGROUND OF THE INVENTION

A framework of this type has become known in the state of the art from, e.g., DE-A-26 37 749. Frameworks of this type have been used for a long time for mounting plumbing units in front of a building wall or in a lightweight partition wall. In the case of mounting in front of a wall, the framework is aligned in relation to the building floor and the wall, it is supported at the wall, and is finally screwed to same. Thus, the height and depth of the framework must be accurately adjusted, which is, of course, essential especially in the case of the mounting of a toilet or a bidet. In this state of the art, the height is set by telescopically adjusting two support feet. Unevennesses of the floor can thus be compensated. The depths of the support feet set are fixed with locking screws. However, this setting is very complicated in practice, especially in the case of uneven floors and the individual mounting, when the mounting is performed without a wall rail, and the feet usually must be loosened, adjusted and fixed again several times.

SUMMARY AND OBJECTS OF THE INVENTION

The primary object of the present invention is to provide a framework of this type, which is especially suitable for the individual mounting of plumbing units, especially toilets, and which makes mounting simple.

The framework according to the present invention is characterized by an adjusting member, which is self-supporting on the foot, is adjustable in height, and on which the support column is supported in a height-adjustable manner. The adjusting member can be fixed on the foot in an approximately preset position in the framework according to the present invention. After the foot has been inserted, the support column is supported on the adjusting member and can now be adjusted for the accurate adjustment. It is essential that the support column always be supported during the adjustment in height, so that it does not have to be loosened each time. This makes possible an especially fine height adjustment. The simplification of mounting helps save time especially if two or even more support feet are present and must be adjusted at the framework.

According to a variant of the present invention, the adjusting member can be fastened on the foot in predetermined locked positions. An appropriate presetting can then be found and fixed in an especially simple manner in conjunction with a suitable marking. According to a variant of the present invention, the locking means is a self-supporting locking means. This makes possible a design in which the presetting is possible without tools.

If the support column is adjustable in height by means of a thread in relation to the foot according to a variant of the present invention, an especially accurate fine setting is possible.

Additional advantageous features appear from the following description, as well as the drawing.

One exemplary embodiment of the present invention will be explained in greater detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
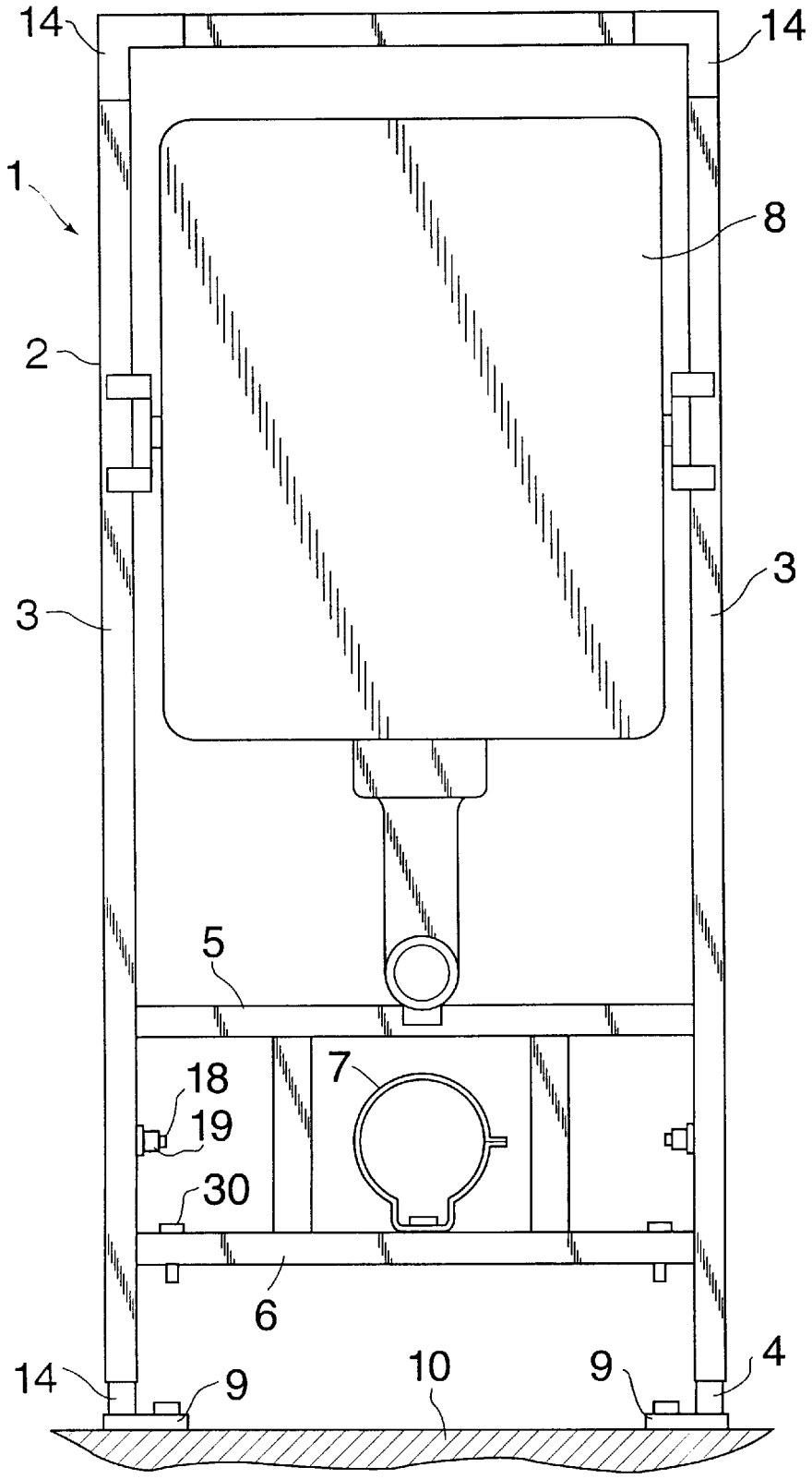
FIG. 1 is a schematic view of a framework according to the present invention.
Figure 3:
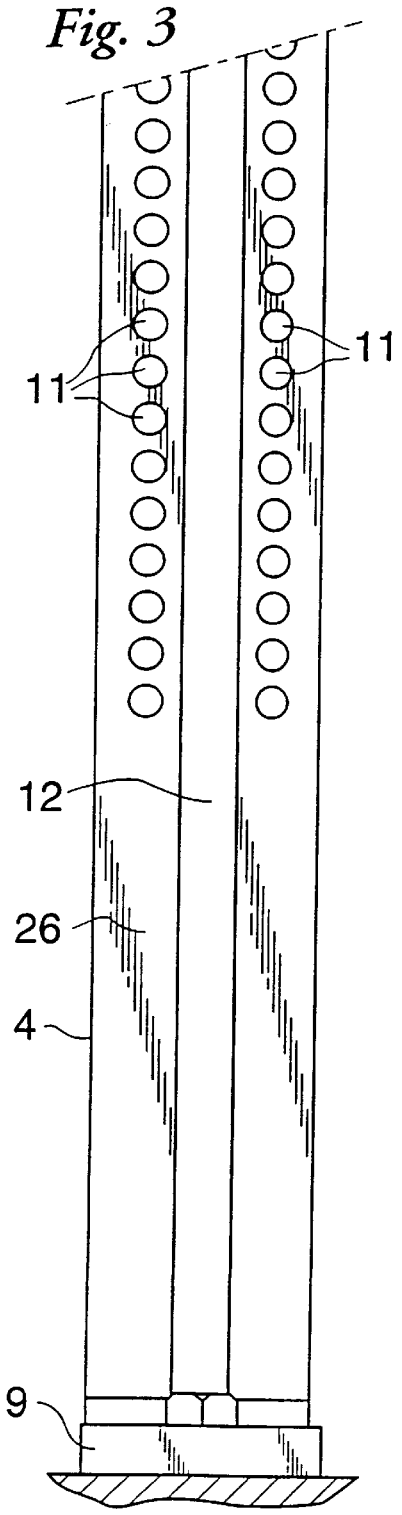
FIG. 3 is a view of a foot.

FIG. 1 shows a mounting framework 1, which has a frame 2 with two vertical and parallel support columns 3 as well as two corner supports 14. A holding means 5, to which, e.g., a toilet bowl can be fastened, and which has a pipe clamp 7 for fixing the drain for this purpose, is fastened, e.g., welded, to the support columns 3. A flush-mounted flush tank 8 is fastened to the frame 2 via the holding means 5.

Figure 2:
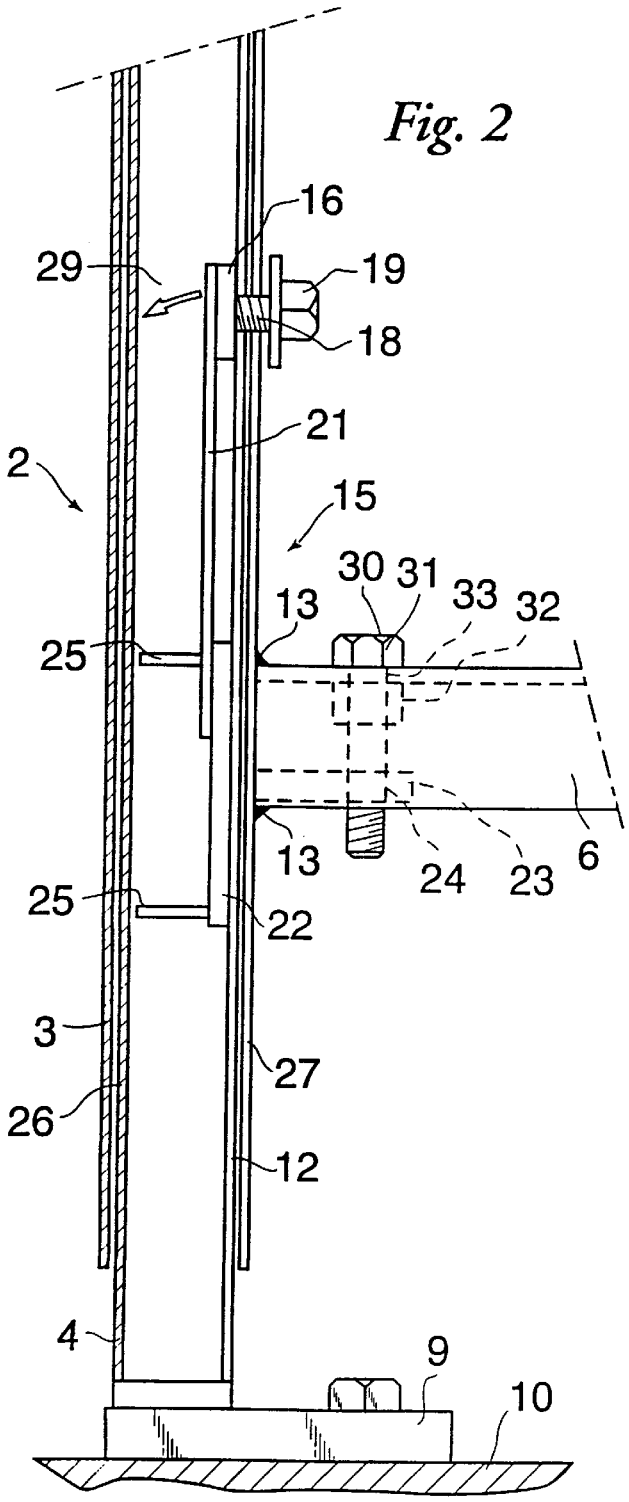
FIG. 2 is a sectional view through a part of the framework according to FIG. 1.
Figure 4:
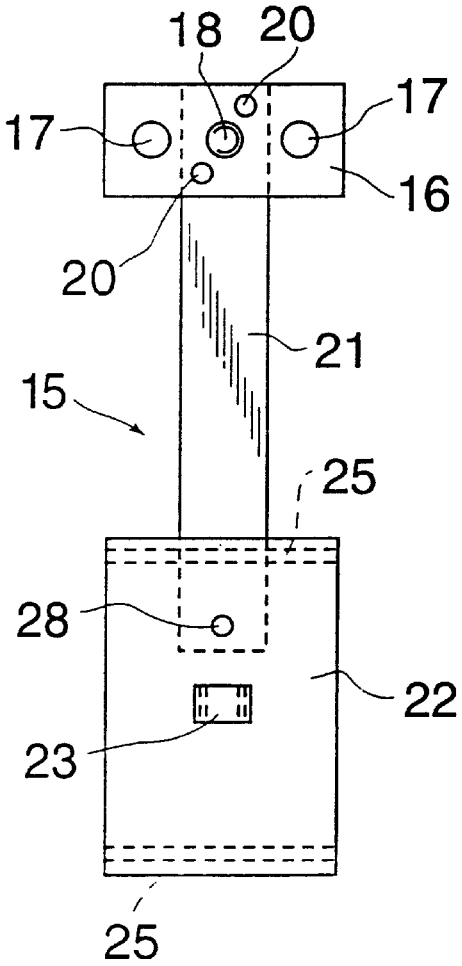
FIG. 4 is a view of an adjusting member.
Figure 5:
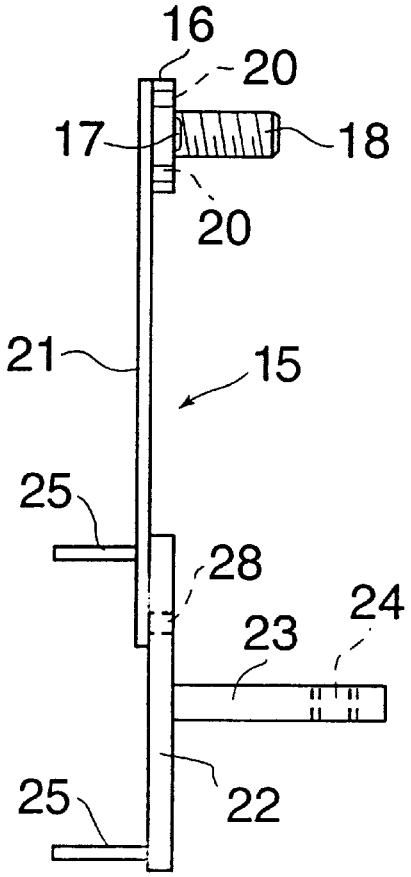
FIG. 5 is a side view of the adjusting member according to FIG. 4.
Figure 6:
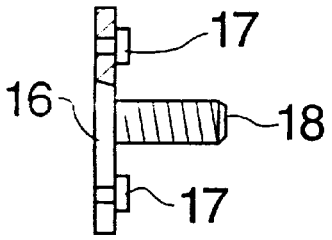
FIG. 6 is another, partially sectional view of the adjusting member.
Figure 7:
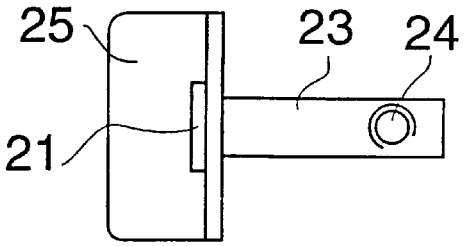
FIG. 7 is another view of the adjusting member.

A foot 4 is telescopically adjustably inserted from below into each support column 3. Each foot 4 is provided with a foot plate 9 and is fixed with same to a building floor 10, e.g., by means of a suitable bolt. Each foot has a special section tube 26 of a C-shaped cross section, which is provided with a slot 12 over its entire length. Two rows of locking openings 11 are provided next to the slot 12. An adjusting member 15, which has an adjusting element 22, which is rigidly connected to a locking element 16 by means of a leaf spring 21, is inserted into the special section tube 26. As is shown in FIG. 2, the locking element 16 and the adjusting element 22 as well as the leaf spring 21 are located inside the hollow section 26.

Two locking cams 17 as well as a setscrew 18 are rigidly arranged on the locking element 16. The setscrew 18 passes through the slot 12 of the foot 4 as well as an elongated hole 27 of the support column 3. A clamping nut 19 is screwed onto the projecting end of the setscrew 18. The leaf spring 21 is fastened to the locking element 16 with two fastening screws 20.

The leaf spring 21 is fastened at the lower end to the adjusting element 22 by means of a fastening screw 28 and is supported on it. The leaf spring 21 holds the adjusting element 22 in the position shown in FIG. 2, in which the locking cams 17 engage two opposite openings 11. This engagement can be released against the reactive force of the leaf spring 21 by the locking element 16 being deflected at the clamping nut 19 in the direction of arrow 29. With the locking connection released, the adjusting member 15 can be displaced as desired in the longitudinal direction of the foot 4 and can be relocked in a desired height position by releasing the clamping nut 19, and its height can thus be fixed. The locking set can be secured by tightening the clamping nut 19.

The adjusting member 15 is rigidly connected to the locking element 16 via the leaf spring 21. Two projections 25, which guide and support the element 15 during the mounting in the hollow section 26, are arranged on the rear side of the element 15.

An arm 23, which extends to the outside through the slots 12 and 27 and has a through threaded hole 24 for receiving and adjusting screw 30 at a free end, is rigidly arranged at the adjusting member 15, approximately centrally. As is shown in FIG. 2, the adjusting screw 30 passes at the top end through a hole 33 of a cross arm 6 of the holding means 5 and is rotatably mounted on the said cross arm 6 by means of a so-called stop nut 32. The cross arm 6 is fastened to the support columns 3 by weld seams 13 on both sides. If the adjusting nut 30 is rotated in the arrangement according to FIG. 2, it is moved up or down, depending on the direction of rotation, and it correspondingly displaces the foot support 3 and the support column 4 in relation to one another. The path of adjustment of the adjusting screw 30 is at least equal to the distance between two adjacent locking openings 11, which is preferably about 10 mm. Each position can thus be set within the locking range of the openings 11 to adjust the adjusting screw 30. Provisions are made for performing an approximate presetting by means of the locking openings 11 and by the corresponding positioning of the locking element 16 at the foot 4 and for performing the fine adjustment by means of the adjusting screw 30 on the basis of this setting. As was explained above, the locking connection between the element 16 and the foot 4 can be released and adjusted at any time. Once the frame 2 has been adjusted, the two clamping nuts 19 are tightened.

The approximate setting of the feet 4 without a tool and the subsequent fine setting with the frame 2 already being supported guarantee the above-mentioned, simpler mounting. The cross arm 6 is not obligatory, because it may be replaced by a simple projection on the support columns 3. It would also be possible to replace the locking connection with a similar, other connection or even by a ridgeless clamping connection. This connection may also be arranged under the adjusting screw 30. Finally, a design in which the foot 4 and the support column 3 are transposed is also conceivable. What is essential is the relative movement between the two parts.

While a specific embodiment of the invention has been shown and described in detail to illustrate the application of the principles of the invention, it will be understood that the invention may be embodied otherwise without departing from such principles.

What is claimed is:

1. A framework for fastening plumbing units, comprising: a vertical support column, a telescopically height-adjustable foot inserted into said vertical support column and connected to said vertical support column; and an adjusting member which is self-supporting at said foot, said adjusting member being adjustable in height along said support column in said foot, said vertical support column being supported to said foot by said adjusting member in a height-adjustable manner, said adjusting member includes self-holding locking means for detachably longitudinally fastening said adjusting member inside said foot at a preselecting locking position, wherein said vertical support column has a longitudinal slot and said foot has a longitudinal slot, said longitudinal slot of said support column and said longitudinal slot of said foot overlapping each other, said adjusting member being located in said foot and having a projecting arm longitudinally spaced apart from said self-holding locking means extending outwardly and passing through said longitudinal slot of said support column and passing through said longitudinal slot of said foot, and said support column being supported in a height-adjustable manner on said projecting arm corresponding to said self-holding means, said self-holding locking means being movable between a lock and unlock position for locking and unlocking said foot from said support column respectively, said locking means including a leaf spring for biasing and locking means in said lock position.

2. A framework according to claim 1, further comprising locking sites defined on said foot for locking said adjusting member to said foot at predetermined locking positions corresponding to said locking sites.

3. A framework according to claim 2, wherein said adjusting member includes at least one locking cam which engages corresponding locking openings at said locking sites of said foot.

4. A framework according to claim 3, wherein said adjusting member further comprises a spring element, said locking cam being held in locking engagement by said spring element.

5. A framework according to claim 3, wherein said adjusting member further comprises fixing means for fixing said locking cam at a position along said foot.

6. A framework according to claim 1, further comprising an adjusting screw operating with said projecting arm for adjusting a height position for said vertical support column in relation to said foot.

7. A framework according to claim 6, wherein said adjusting screw forms a fine adjustment for adjusting a height position of said vertical support column.

8. A framework according to claim 2, further comprising a fine adjustment means on said projecting arm for adjusting a height position of said support column relative to said foot, a range of said fine adjustment at least corresponding to a locking distance defined by a spacing between said sites.

9. A framework according to claim 1, further comprising: another vertical support column; another telescopically height adjustable foot inserted into said another vertical support column; and another adjusting member which is self-supporting at said another foot, said another adjusting member being adjustable in height along said another support column in said another foot, said another vertical support column being supported by said another adjusting member for adjusting a position of said another foot with respect to said another support column, said support column and another said support column being connected by a cross member, whereby the position of said foot and said support column and a position of said another foot and said another support column may be adjusted in unison or may be adjusted independently.

10. A framework for fastening plumbing units comprising:

a vertical support column with a longitudinal slot;

a telescopically height-adjustable foot inserted into said vertical support column and connected to said vertical support column, said foot having a longitudinal slot;

an adjusting member which is self-supporting at said foot, said adjusting member being adjustable in height along said support column in said foot, said vertical support column being supported to said foot by said adjusting member in a height-adjustable manner, said adjusting member includes self-holding locking means for detachably fastening said adjusting member to said foot and having a projecting arm longitudinally spaced apart from said self-holding locking means extending outwardly to pass through said longitudinal slot of said support column and through said longitudinal slot of said foot;

an adjusting screw for adjusting a height position of said vertical support column in relation to said foot, said adjusting screw engaging said projecting arm to form a fine adjustment corresponding said self-holding locking means for adjusting a height position of said vertical support column.

11. A framework according to claim 10, wherein said longitudinal slot of said support column and said longitudinal slot of said foot overlapping each other, said adjusting member passing through said longitudinal slot of said support column and passing through said longitudinal slot of said foot.

12. A framework according to claim 10, further comprising locking sites defined on said foot for locking said adjusting member to said foot at predetermined locking positions corresponding to said locking sites.

13. A framework according to claim 12, wherein said adjusting member includes at least one locking cam which engages corresponding locking openings at said locking sites of said foot.

14. A framework according to claim 13, wherein said adjusting member further comprises a spring element, said locking cam being held in locking engagement by said spring element.

15. A framework according to claim 13, wherein said adjusting member further comprises fixing means for fixing said locking cam at a position along said foot.

16. A framework in accordance with claim 10, wherein:

said self-holding locking means is movable between a lock and unlock position for locking and unlocking said foot from said support column respectively, said locking means including a spring means for biasing said locking means in said lock position.

17. A framework in accordance with claim 16, wherein:

said spring means includes a leaf spring.

* * * * *